US006997111B2

(12) United States Patent
Giegerich

(10) Patent No.: US 6,997,111 B2
(45) Date of Patent: Feb. 14, 2006

(54) COLLAPSIBLE TABLE

(75) Inventor: Paul Giegerich, Laverock, PA (US)

(73) Assignee: DMI Sports, Inc., Fort Washington, PA (US)

( * ) Notice: Subject to any disclaimer, the term of this patent is extended or adjusted under 35 U.S.C. 154(b) by 137 days.

(21) Appl. No.: 10/699,344

(22) Filed: Oct. 31, 2003

(65) Prior Publication Data

US 2004/0139892 A1 Jul. 22, 2004

Related U.S. Application Data

(60) Provisional application No. 60/440,714, filed on Jan. 16, 2003.

(51) Int. Cl.
*A47B 85/00* (2006.01)

(52) U.S. Cl. ..... 108/25; 108/115

(58) Field of Classification Search ..... 108/25, 108/26, 50.12; 248/164, 436, 156; 135/16
See application file for complete search history.

(56) References Cited

U.S. PATENT DOCUMENTS 2,039,805 A * 5/1936 Knight ..... 108/50.12
2,140,685 A * 12/1938 Baxter ..... 108/119
2,281,309 A * 4/1942 Kennedy ..... 108/25
2,454,202 A * 11/1948 Pierik ..... 108/25
3,034,153 A * 5/1962 Sargent ..... 108/25
3,624,732 A * 11/1971 Bowden ..... 108/50.12
4,122,780 A * 10/1978 Brickman ..... 108/25
4,177,737 A * 12/1979 Brickman ..... 108/25
4,296,693 A * 10/1981 Archer ..... 108/50.12
4,625,655 A * 12/1986 Brickman ..... 108/25
5,592,884 A * 1/1997 Glick et al. ..... 108/25
6,321,662 B1 * 11/2001 Fraise ..... 108/25
6,439,133 B1 * 8/2002 Jaramillo ..... 108/25
6,505,565 B1 * 1/2003 Byung et al. ..... 108/115

FOREIGN PATENT DOCUMENTS

FR 2551333 A3 * 3/1985

* cited by examiner

*Primary Examiner*—Jose V. Chen
(74) *Attorney, Agent, or Firm*—Akin Gump Strauss Hauer & Feld, LLP

(57) ABSTRACT

A collapsible table comprises a frame formed from a plurality of pivotally connected frame members, the frame being movable between an expanded configuration and a collapsed configuration. A table top is connected to the frame, the table top including at least one drink holder. A container assembly having a flange portion is provided with mounting holes and a container pouch. The container assembly is connected to the frame at a position beneath the table top by the plurality of frame members being inserted though the mounting holes.

17 Claims, 3 Drawing Sheets

COLLAPSIBLE TABLE

CROSS-REFERENCE TO RELATED APPLICATIONS

This application claims benefit of U.S. Provisional Patent Application No. 60/440,714, "Foldable Party Table", filed Jan. 16, 2003.

BACKGROUND OF THE INVENTION

The present invention relates generally to portable furniture and, more particularly, to a collapsible and portable table suitable for indoor or outdoor use.

Collapsible and portable furniture is well known in the art, particularly collapsible and portable chairs, but also collapsible and portable tables. Such furniture is particularly useful in connection with sporting events, camping, picnics or other outdoor activities. Standard tables typically simply provide an elevated, flat supporting surface. Drink containers or bowls placed on a standard table are susceptible to being overturned, while lightweight eating utensils, napkins and other accessories are susceptible to being blown off of the table by a passing breeze. A need exists, therefore, for a collapsible and portable table which reduces the potential of overturning of drink containers and bowls and which also reduces the potential for lightweight eating utensils, napkins and other accessories of being blown about.

BRIEF SUMMARY OF THE INVENTION

Briefly stated, the invention is a collapsible table comprising: a frame formed from a plurality of pivotally connected frame members, the frame being movable between an expanded configuration and a collapsed configuration. A table top is connected to the frame, the table top including at least one drink holder. A container assembly having a flange portion is provided with mounting holes and a container pouch. The container assembly is connected to the frame at a position beneath the table top by the plurality of frame members being inserted though the mounting holes.

BRIEF DESCRIPTION OF THE SEVERAL VIEWS OF THE DRAWINGS

The following detailed description of a preferred embodiment of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1A:
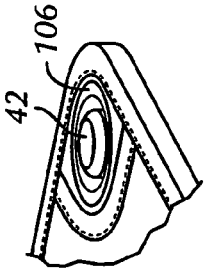
FIG. 1A is an enlarged detail view of a corner of the collapsible table of FIG. 1.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the collapsible table or designated parts thereof. The terminology includes the words above specifically mentioned, derivatives thereof and words of similar meaning.

Figure 1:
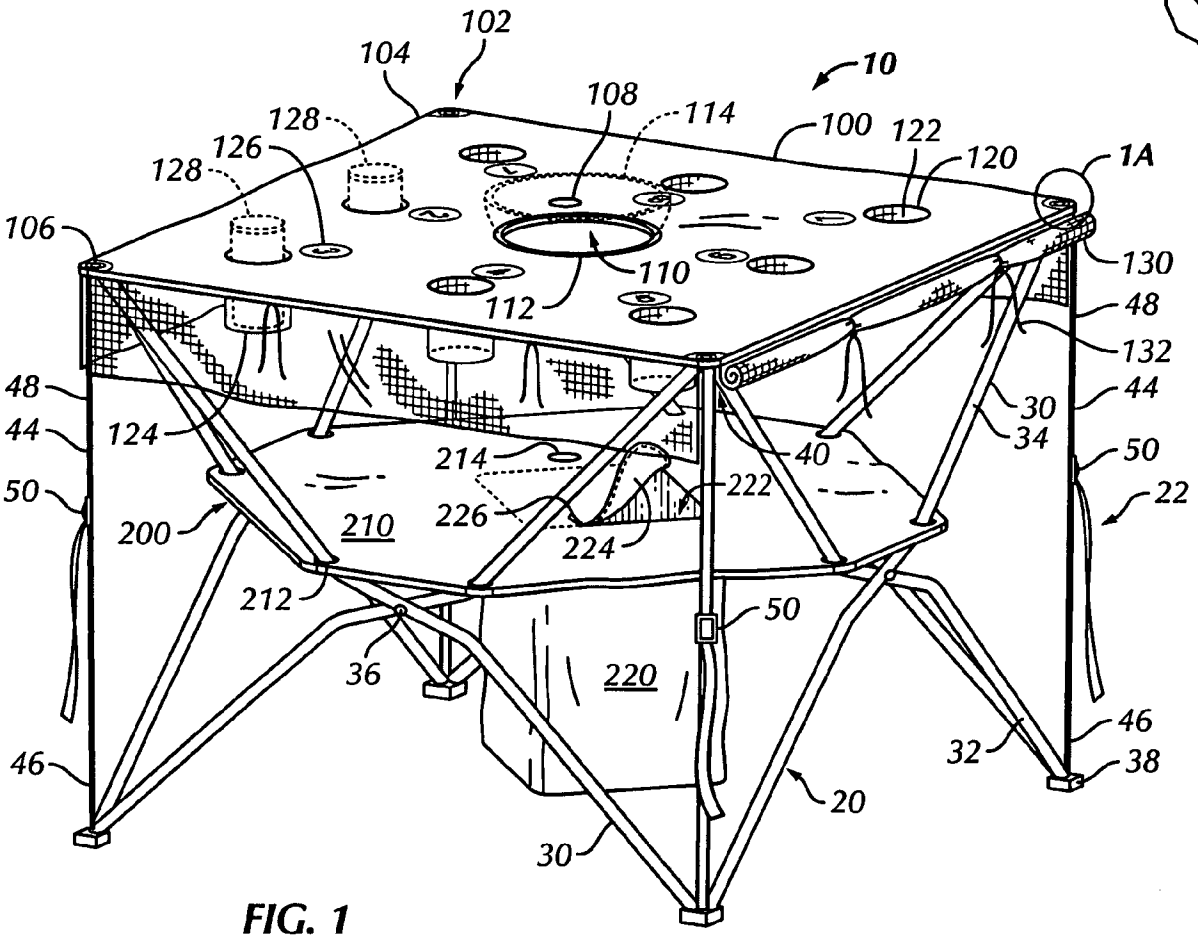
FIG. 1 is a side perspective view of a collapsible table, shown in an expanded configuration, in accordance with a preferred embodiment of the present invention.
Figure 2:
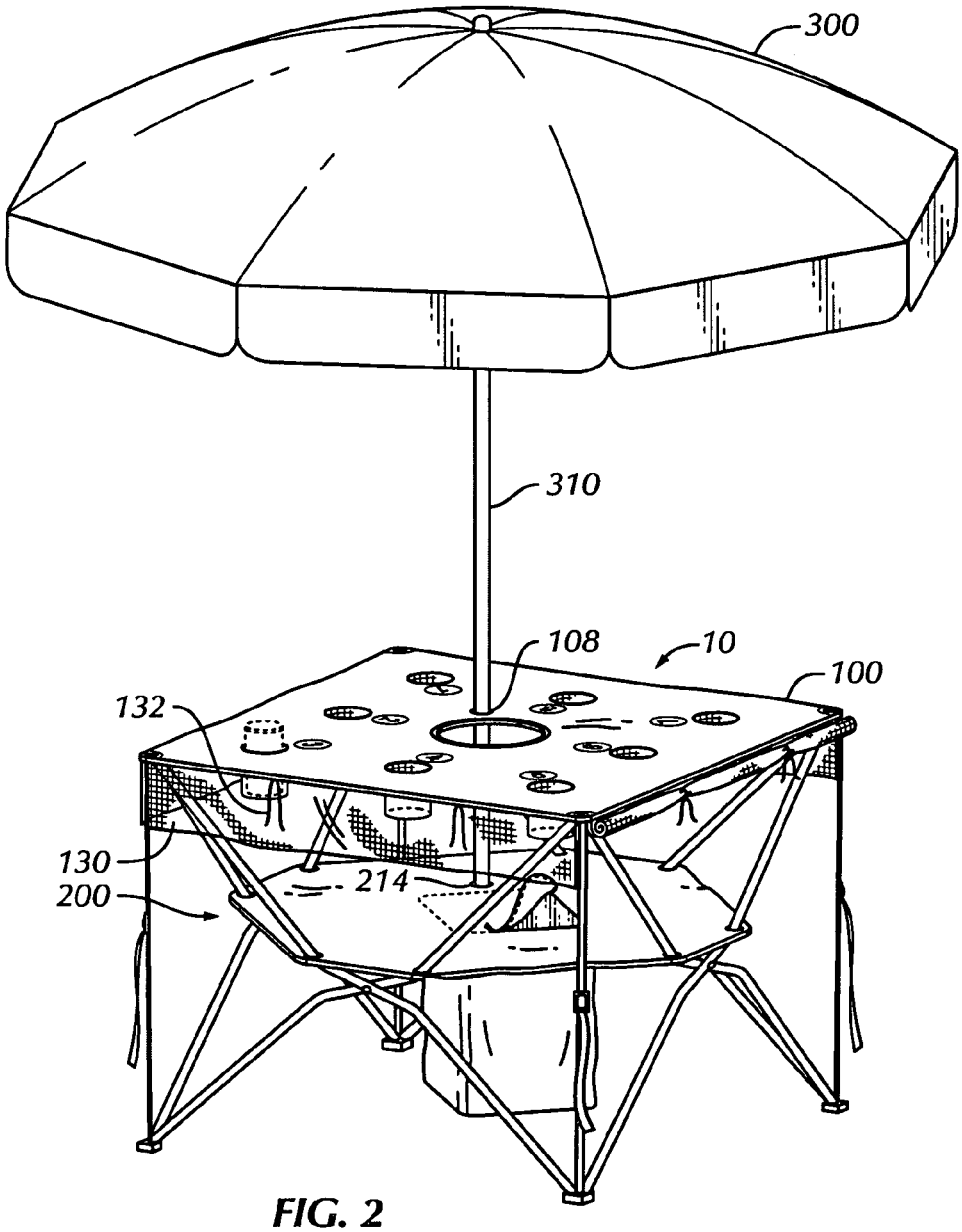
FIG. 2 is a side perspective view of the collapsible table of FIG. 1 in combination with an umbrella.
Figure 3:
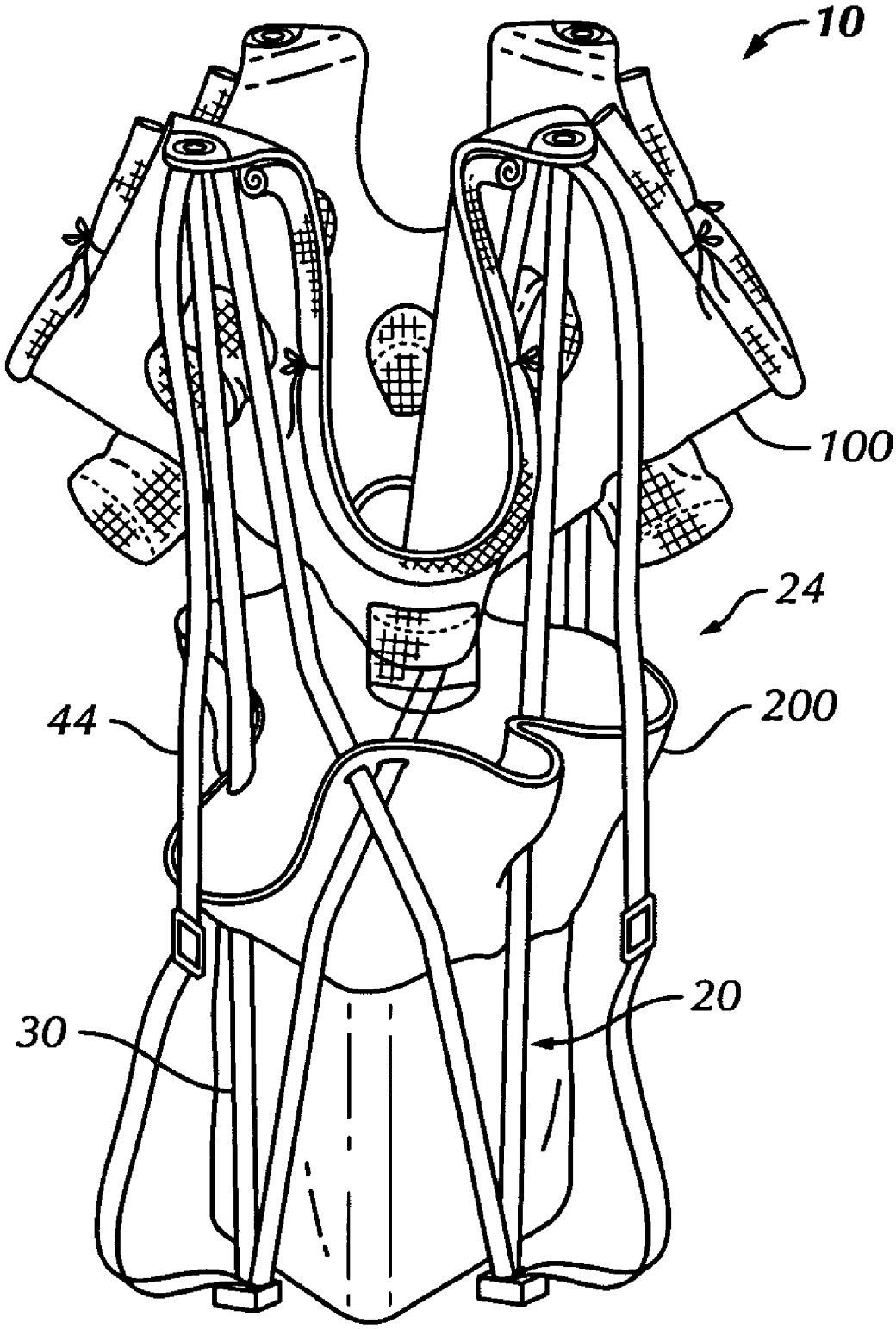
FIG. 3 is a side perspective view of the collapsible table of FIG. 1, shown in a collapsed configuration.

Referring to the drawings, wherein like referenced numerals are used to designate the same components throughout the several figures, there is shown in FIGS. 1–3 in accordance with a preferred embodiment of the present invention a collapsible and portable table especially well-suited for outdoor activities. FIG. 1 shows the collapsible table 10. The table 10 is shown to include three major elements: a frame 20, a table top 100 and a container 200 which may be insulated and which may function as a cooler. The frame 20 is shown in FIGS. 1 and 2 in an assembled, expanded configuration 22, while the frame 20 is shown in FIG. 3 in a collapsed configuration 24.

The frame 20 is formed from eight pivotally connected frame members 30 and four vertical strap members 44. The frame members 30 each have a first, lower end 32 and an second, upper end 34. Each frame member 30 is pivotally connected to a first, lower joint 38 at the first, lower end 32, a second, upper joint 40 at the second, upper end 34 and to a third, mid-span joint 36 at a point intermediate the first and second ends 32, 34, preferably near a mid-point of the frame member 30. Pins 42, the function of which is described herein below, extend upwardly from the upper joints 40. The frame members 30 are preferably fabricated from aluminum or steel tubing, although other metallic, wood, polymeric or composite materials could be substituted.

The straps 44 each connect at a first lower end 46 with a first, lower joint 38 and at a second upper end 48 with a second, upper joint 40. The straps 44 are adjustable in length, preferably with a conventional buckle 50. In a preferred embodiment, the straps 44 are fabricated from nylon webbing. From this disclosure, the artisan will recognize that other flexible materials having good tensile strength could be substituted.

In the embodiment illustrated, the table top 100 is of a generally square shape, with four corners 102 and four edges 104 and is removably attachable to the frame 20. In an alternative embodiment, the table top 100 is fixedly attached to the frame 20. For the embodiment illustrated, a grommet 106 is disposed at each of the four corners 102. When the four grommets 106 are assembled over the four pins 42, as is shown in the detail FIG. 1A, and the frame 20 is in the expanded configuration 22, the table top 100 is stretched taut and is supported by the four pins 42.

The table top 100 includes a plurality of drink holders 120. Each drink holder 120 is formed by a circular drink holder opening 122 in the table top 100 and a drink pocket 124 disposed beneath the drink holder openings 122 and fixedly attached to the table top 100. The drink holder openings 122 may be color-coded or numbered using indicia 126 or otherwise identified to allow a user to identify his or her drink container 128.

The table top 100 further comprises a larger central opening 110. The central opening 110 may have a circumferential edge reinforcing member 112 along the circumference of the central opening 110. The central opening 110 is sufficiently large to receive and accommodate a large bowl 114, illustrated in phantom. The bowl 114 may be filled, for example, with items such as snacks or other food items. The bowl 114 may either be a standard commercially available bowl (for example, a plastic or glass bowl) or alternatively a flexible container (not illustrated) disposed beneath the central opening 110 may be supplied with the collapsible table 10.

The table top 100 may further comprise side pockets 130 attached to one or more of the table edges 104. The side pockets 130 may be used to store food items, napkins, eating utensils, condiments or other accessories. When not in use, the side pockets 130 may be bundled using tie straps 132.

FIG. 2 illustrates an umbrella 300 with umbrella pole 310 which may be used with the table 10. A first umbrella pole opening 108 may be disposed in the table top 100 to accommodate the umbrella pole 310. The first umbrella pole opening 108 is of sufficient diameter to allow a pole 310 of an umbrella 300 to be inserted through the table top 100.

The table top 100 and optional flexible container (not shown) are preferably fabricated from a durable, resilient and flexible cloth material such as CORDURA®, although other materials, for example, SPANDURA® could be substituted. The drink pockets 124 and side pockets 130 are preferably made from a durable, resilient and flexible mesh cloth material such as nylon. Use of a mesh material facilitates drainage of any condensation forming on an outer surface of the drink containers 128 held within the drink pockets 124. Furthermore, a mesh material allows a user to conveniently see what items are disposed within the side pockets 130. Table top 100 materials are preferably washable and capable of receiving a printed or silk-screened image, such as the indicia 126. From this disclosure, the artisan would recognize that an alternative table top (not illustrated) with a continuous surface and with a game table design disposed on the continuous surface could be substituted for the table top 100 disclosed herein.

The container 200 includes a top flange portion 210 extending in a generally horizontal plane when the container 200 is assembled with the frame 20. A plurality of holes 212 are provided near an outer edge of the flange portion 210. Each of the diagonal frame members 30 is inserted through a hole 212 to secure the container 200 to the frame 20. The container 200 is thus slidingly connected to the frame 20. The top flange portion 210 includes a container opening 222, the container opening 222 being covered with a closeable flap 224. The flap 224 may be held closed by a variety of methods, including a zipper 226, as illustrated. Snaps or other fasteners (not illustrated) could be substituted. Extending downwardly from the container opening 222 is a container pouch 220. The container pouch 220 is preferably insulated, and may be provided with drainage holes (not shown).

A second umbrella pole opening 214 may be disposed in the flange portion 210 to accommodate the umbrella pole 310. The second umbrella pole opening 214 is of sufficient diameter to allow the pole 310 of the umbrella 300 to be inserted through the flange portion 210.

The flange portion 210, flap 224 and exterior and interior shells of the container pouch 220 are all preferably fabricated from a durable, resilient and flexible cloth material such as CORDURA®, although other materials, for example SPANDURA® could be substituted. A lightweight and flexible insulation, such as a poly-foam material, is preferably used for the container pouch 220 insulation.

In use, if the table top 100 is detachable, the table top 100 is assembled with the frame 20, installing the grommets 106 over the pins 42. If the table top 100 is affixed to the frame 20, this step of assembling the table top 100 to the frame 20 is not required. The frame 20 is moved to the expanded configuration 22, and the straps 44 are fully tightened using the buckles 50 to draw the table top 100 taut, forming a rigid or semi-rigid surface. A user may then proceed to put ice and items to be cooled, such as canned drinks or food, in the container pouch 220 or alternatively place heated items in the container pouch 220 to help maintain their warmth. The user may further proceed to place the bowl 114 (or alternatively may use the flexible container (not shown) disposed beneath the central opening 110) within the table top central opening 110 and drink containers 128, napkins, lightweight eating utensils or other items within the drink pockets 124. Food items, napkins, eating utensils, condiments, or other items could also be stored within the optional side pockets 130. Upon disassembly, the corner straps 44 are loosened, allowing the frame 20 and container 200 to be collapsed into the collapsed configuration 24, facilitating storage and transport. The table top 100 is washable, facilitating cleaning of the table top 100 after use.

From the foregoing it can be seen that the present invention comprises a collapsible and portable table especially useful for outdoor activities such as those associated with sporting events, picnics, or camping. It will be appreciated by those of ordinary skill in the art that modifications may be made to the above described embodiment without departing from the scope and spirit of the present invention.

I claim:

1. A collapsible table comprising:

a frame formed from a plurality of pivotally connected frame members, the frame being movable between an expanded configuration and a collapsed configuration;

a table top connected to the frame, the table top including at least one drink holder;

a container assembly having a flange portion provided with mounting holes, and a container pouch, the flange extending from the container pouch toward and encompassing the mounting holes, whereby the container assembly is connected to the frame at a position beneath the table top by the plurality of frame members being inserted though the mounting holes.

2. The collapsible table of claim 1 in combination with a bowl, the table top further comprising an opening sized and shaped to receive the bowl.

3. The collapsible table of claim 1, wherein the table top and the container assembly are fabricated from flexible materials allowing the table top and the container assembly to flexibly collapse with the frame as the frame is moved between the expanded configuration and the collapsed configuration.

4. The collapsible table of claim 3 wherein the table top is fabricated from a fabric material.

5. The collapsible table of claim 1, wherein each of the plurality of frame members is pivotally connected at a first end to a first joint and at a second end to a second joint and at a point intermediate the first and second ends to an other frame member at a third joint.

6. The collapsible table of claim 5, wherein the frame further comprises a plurality of corner straps, each corner strap being vertically connected between the first joint and the second joint.

7. The collapsible table of claim 6, wherein the corner straps are adjustable in length and capable of being tightened.

8. The collapsible table of claim 1, further comprising a table top umbrella hole and a container assembly flange umbrella hole.

9. The collapsible table of claim 8 in combination with an umbrella having a support pole, wherein the support pole is inserted and retained within the table top umbrella hole and the container assembly flange umbrella hole.

10. The collapsible table of claim 1, further comprising at least one pocket.

11. The collapsible table of claim 10, wherein the at least one pocket is attached along at least one edge of the table top.

12. The collapsible table of claim 1, wherein the table top is releasably connectable to the frame.

13. The collapsible table of claim 12, the frame further comprising protruding a plurality of pins and the table top further comprising a plurality of grommets, wherein engagement of the grommets with the pins releasably connects the table top to the frame.

14. The collapsible table of claim 1, wherein the table top is fixedly attached to the frame.

15. The collapsible table of claim 1, wherein the container pouch is insulated.

16. The collapsible table of claim 1, wherein the frame members are fabricated from a rigid material.

17. The collapsible table of claim 16, wherein the rigid material is steel, aluminum or alloys thereof.

* * * * *